US007665813B2

(12) United States Patent
Wang

(10) Patent No.: US 7,665,813 B2
(45) Date of Patent: Feb. 23, 2010

(54) PROTECTION MECHANISM FOR CONNECTORS

(75) Inventor: Zhao-Yu Wang, Guangdong (CN)

(73) Assignees: Hong Fu Jin Precision Industry (Shen Zhen) Co., Ltd., Shenzhen, Guangdong Province, P.R.C.; Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 437 days.

(21) Appl. No.: 11/306,454

(22) Filed: Dec. 29, 2005

(65) Prior Publication Data

US 2006/0266746 A1 Nov. 30, 2006

(30) Foreign Application Priority Data

May 28, 2005 (CN) ..... 2005 2 0059234 U

(51) Int. Cl.
*E05C 7/06* (2006.01)

(52) U.S. Cl. ..... 312/220; 312/222; 292/163

(58) Field of Classification Search ..... 292/137, 292/163, 146, 150; 312/109, 215, 216, 217, 312/218, 219, 220, 221, 222, 223.2, 324, 312/333

See application file for complete search history.

(56) References Cited

U.S. PATENT DOCUMENTS

| | | | | |
|---|---|---|---|---|
| 1,790,130 | A * | 1/1931 | Austin | 312/222 |
| 3,133,772 | A * | 5/1964 | Brandes et al. | 312/108 |
| 4,984,982 | A | 1/1991 | Brownlie et al. | |
| 5,287,245 | A * | 2/1994 | Lucente et al. | 361/679.17 |
| 5,626,374 | A * | 5/1997 | Kim | 292/170 |
| 5,722,705 | A * | 3/1998 | Deguchi | 292/87 |
| 5,769,646 | A | 6/1998 | Cavello et al. | |

* cited by examiner

*Primary Examiner*—Janet M Wilkens
*Assistant Examiner*—Matthew W Ing
(74) *Attorney, Agent, or Firm*—Winston Hsu

(57) ABSTRACT

A protection mechanism is provided for protecting connectors which are to be connected to electronic interfaces at a rear panel of a computer chassis. The protection mechanism includes a bracket secured to the rear panel, a first cover pivotally attached to the bracket for shielding the connectors, a second cover pivotally attached to the bracket, and a locking device. The first cover defines a plurality of slots for extension of cables of the connectors therethrough. The second cover is closed to abut against a side panel of the computer chassis to prevent the side panel from withdrawal. The locking device is so arranged between pivot ends of the first and second covers, that one of the first and second covers can be opened only when the other one is opened.

6 Claims, 6 Drawing Sheets

PROTECTION MECHANISM FOR CONNECTORS

CROSS-REFERENCES TO RELATED APPLICATION

Relevant subject matter is disclosed in the copending U.S. patent application Ser. No. 11/156,518, filed on Jun. 20, 2005, and entitled "PROTECTION DEVICE FOR CONNECTORS," and the copending U.S. patent application Ser. No. 11/306,452, filed on the same date and having a same title with the present application, which are assigned to the same assignee with this patent application.

1. Field of the Invention

The present invention relates to a protection mechanism for connectors connected to a computer.

2. Description of Related Art

Developments in networks and a great diversity of computer performances have resulted in more and more input/output interfaces disposed at a computer chassis. A typical computer chassis includes a plurality of connectors connected with cables. These cables include a power cable, a signal cable connecting a monitor, a mouse cable, a keyboard cable, a network cable, a microphone cord, and an earphone cord, etc. These cables are often in a mess at a rear panel of a computer, thereby resulting inconvenient during assembling or disassembling the computer.

In addition, the connectors at the rear panel are exposed in the air. Dust is often accumulated thereby affecting signal transfer. Furthermore, the connectors connected to the rear panel of the computer chassis are susceptible to being broken of or inadvertently disconnected because the connectors typically extend outwardly from the rear panel a substantial distance.

What is desired, therefore, is to provide a protection mechanism for protecting connectors of a computer from contamination or being damaged.

SUMMARY OF INVENTION

In one preferred embodiment, a protection mechanism is provided for protecting connectors which are to be connected to electronic interfaces at a rear panel of a computer chassis. The protection mechanism includes a bracket secured to the rear panel, a first cover pivotally attached to the bracket for shielding the connectors, a second cover pivotally attached to the bracket, and a locking device. The first cover defines a plurality of slots for extension of cables of the connectors therethrough. The second cover is closed to abut against a side panel of the computer chassis to prevent the side panel from withdrawal. The locking device is so arranged between pivot ends of the first and second covers, that the second cover can be opened only when the first cover is opened.

The protection mechanism further includes a lock to lock the first cover to the bracket.

In this preferred embodiment, the side panel can be disassembled only when the second cover is opened, and the second cover can be opened only when the first cover is opened. Thus, only one lock can control the two covers and the side panel.

Other advantages and novel features will become more apparent from the following detailed description of preferred embodiments when taken in conjunction with the accompanying drawings, in which:

DETAILED DESCRIPTION

Figure 1:
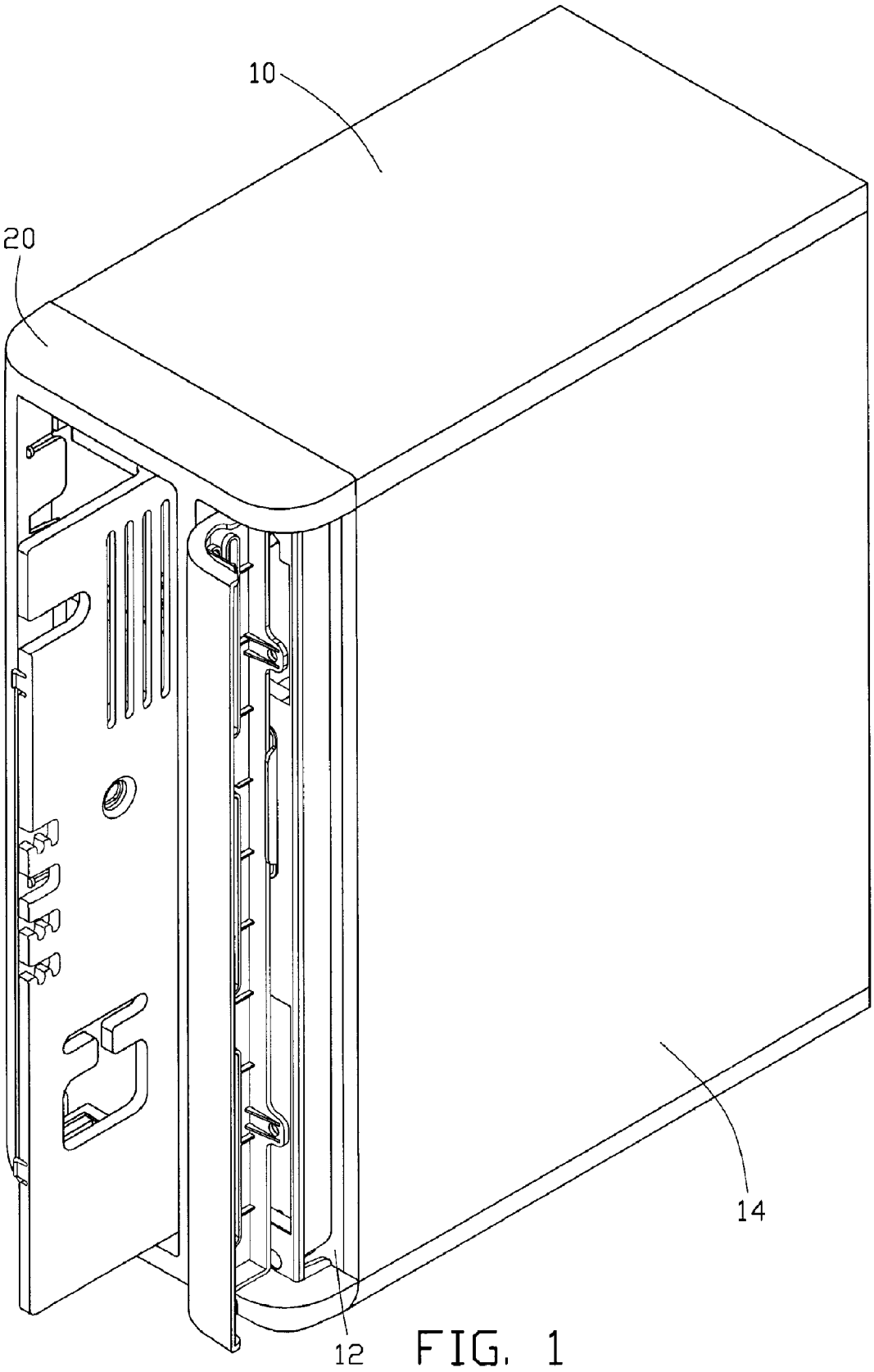
FIG. 1 is an isometric view of a protection mechanism in accordance with a preferred embodiment of the present invention, the protection mechanism being attached to a computer chassis, and including a bracket, a first cover, a second cover, two locking devices, and a lock.
Figure 2:
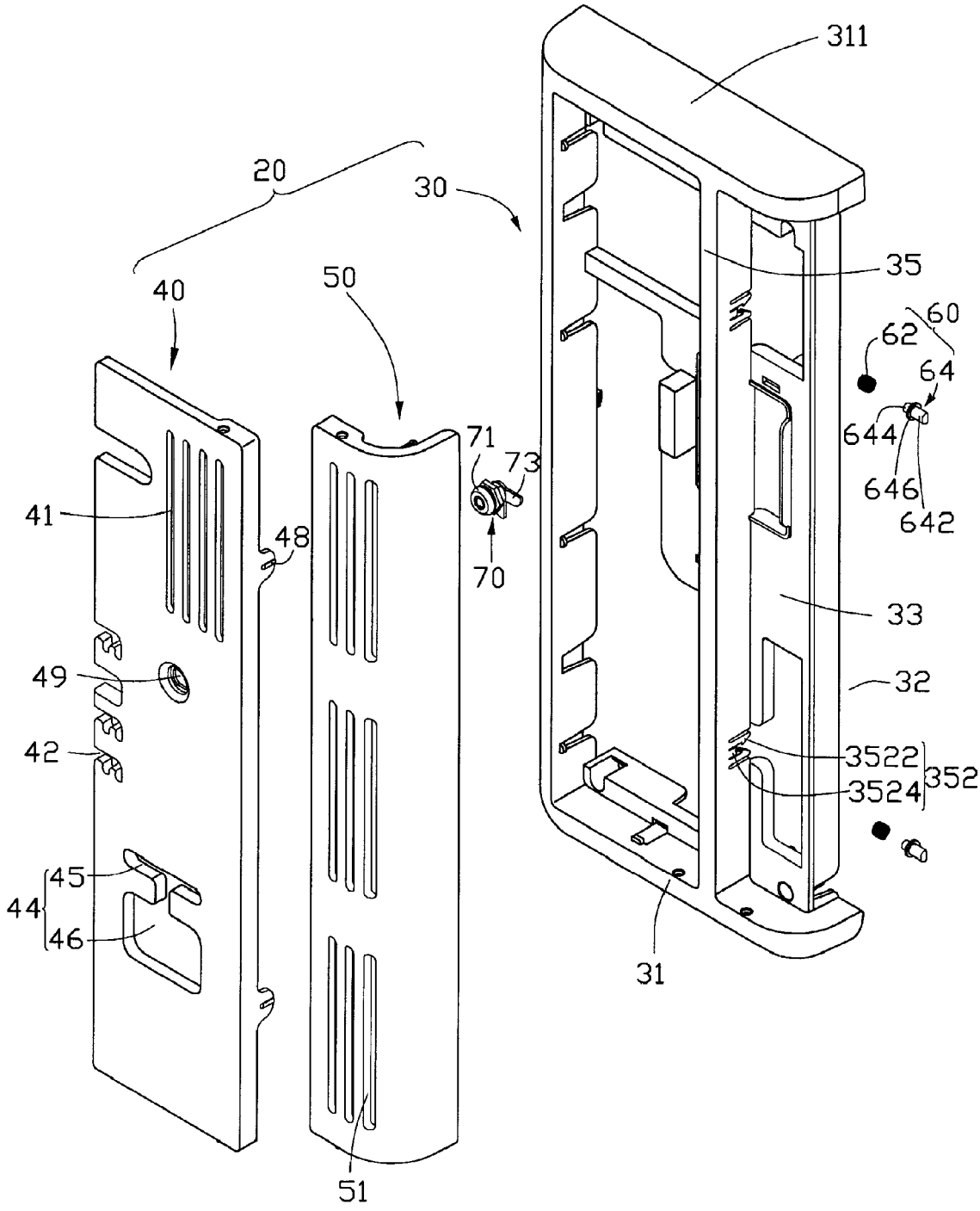
FIG. 2 is an explosive, isometric view of the protection mechanism of FIG. 1.
Figure 3:
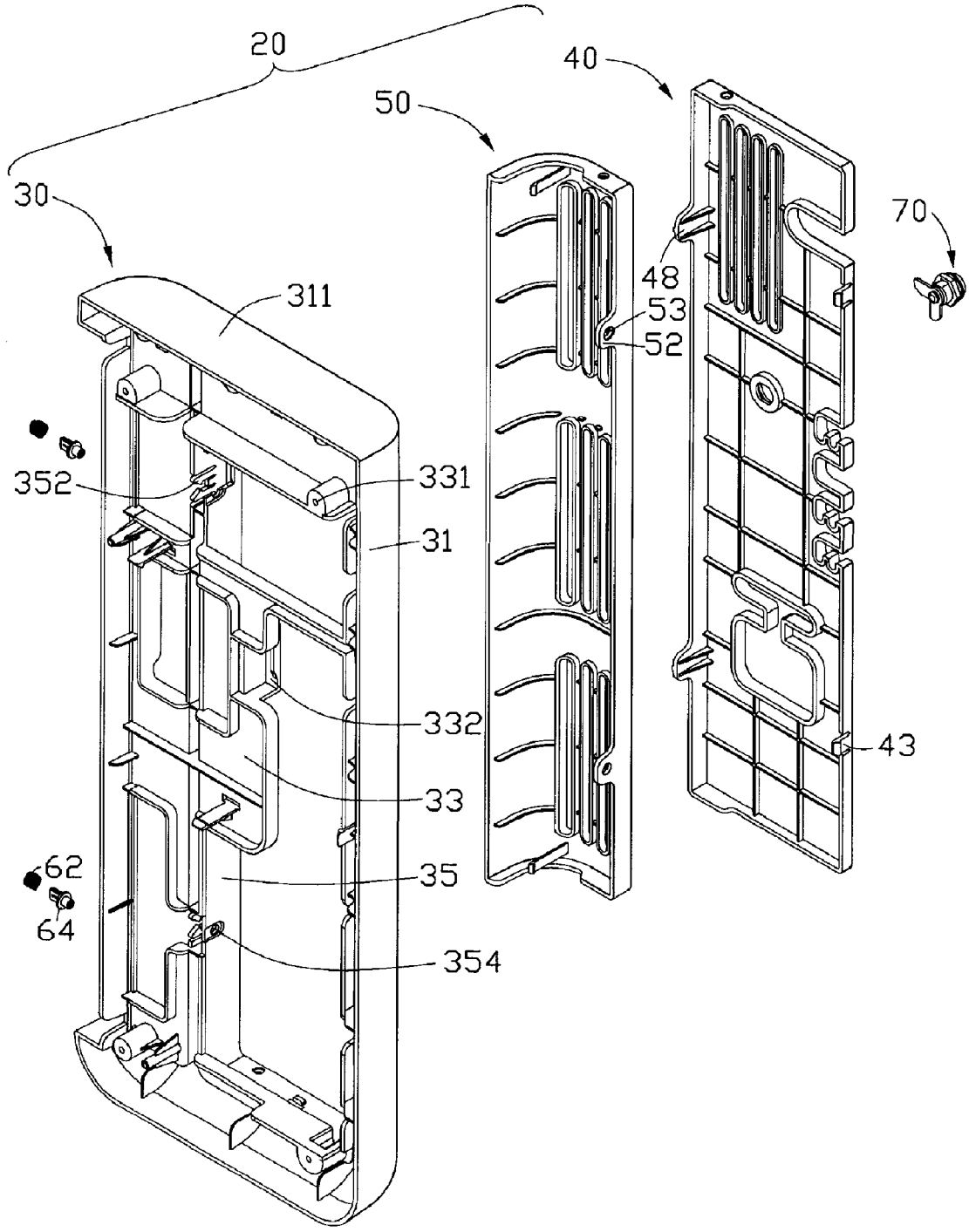
FIG. 3 is similar to FIG. 2, but viewed from another aspect.

Referring to FIGS. 1-3, a protection mechanism 20 for connectors in accordance with a preferred embodiment of the present invention is to be attached to a rear panel 12 of a computer chassis 10. The protection mechanism 20 includes a bracket 30, a first cover 40, a second cover 50, two locking devices 60, and a fastening device such as a lock 70. The computer chassis 10 further includes a side panel 14. The side panel 14 is slidably attached to the computer chassis 10 in a back-to-front direction. In another preferred embodiment, the side panel 14 is rotatably attached to the computer chassis 10 at a side near the rear panel 12. Each locking device 60 includes a resilient member and a latch 64. In this embodiment, the resilient member is a coil spring 62. The latch 64 includes a first pin portion 642, a second pin portion 644, and a flange 646 located between the first pin portion 642 and the second pin portion 644. The first pin portion 642 is a semi-column.

The bracket 30 includes a U-shaped outer frame 31, and an inner frame 33. The outer frame 31 has a cutout 32 corresponding to the side panel 14 of the computer chassis 10. The outer frame 31 includes two arm portions 311, and a crossbeam 35 perpendicularly connecting the arm portions 311. The crossbeam 35 divides the outer frame 31 into two regions, one larger than the other. The first cover 40 is pivotally accommodated in the larger region, and the second cover 50 is pivotally accommodated in the smaller region. Pivot ends of the first and second covers 40, 50 are in the vicinity of the crossbeam 35. A cross section of the crossbeam 35 is U-shaped, and includes an opening facing the rear panel 12 and two side plates perpendicular to the rear panel 12. The crossbeam 35 includes two through holes 354 defined in one side plate adjacent the larger region, and two fastening portions 352 formed at the other side plate adjacent the smaller region. Each fastening portion 352 includes two opposite hooks 3522 and a post 3524 disposed between the hooks 3522. A receiving section is thereby defined between the hooks 3522 and the post 3524, for receiving the first pin portion 642 of the latch 64.

The inner frame 33 is recessedly formed between the arm portions 311 of the outer frame 31 for reinforcing the bracket 30. Four threaded holes 331 are defined in four corners of the inner frame 33, respectively. The bracket 30 is thereby secured to the rear panel 12 of the computer chassis 10 via screws. The inner frame 33 defines a plurality of openings in order not to shield the input/output interfaces. A locking portion 332 is formed at the inner frame 33 besides one of the openings.

Referring also to FIG. 3, the first cover 40 is rectangular, and defines a plurality of ventilation holes 41 therein. One side away from a pivot end of the first cover 40 defines a plurality of through slots 42 for extension of cables of connectors therethrough, and forms two catches 43. The through slots 42 may be serration-shaped for accommodating multiple cables. The first cover 40 defines an opening 44 which includes a narrow accommodating slot 45, and a large assembly slot 46. A slim connecting slot communicates the accommodating slot 45 and the assembly slot 46. The accommodating slot 45 is located aligning with an expansion-slot zone which has input/output electronic interfaces such as expansion cards. The accommodating slot 45 collects cables of the connectors that are connected to the electronic interfaces. There may be more than one accommodating slot 45 communicating with each other. The assemble slot 46 is offset from the expansion card slots. The assemble slot 46 is set to be relatively large because a connector connected to an expansion card sometimes may be large. The accommodating slot 45 is set to be relatively narrow because the connector connected to the expansion card is not allowed to be unscrewed and pulled out through the accommodating slot 45. Thus, the connector and its cable are permitted to be pulled out only when the first cover 40 is rotated outwardly. Two blocking plates 48 extend perpendicularly from the first cover 40 at the pivot end thereof.

The second cover 50 is substantially arc-shaped, and defines a plurality of ventilation holes 51. Two lugs 52 perpendicularly extend from the pivot end of the second cover 50. A through aperture 53 is defined in each lug 52.

Figure 4:
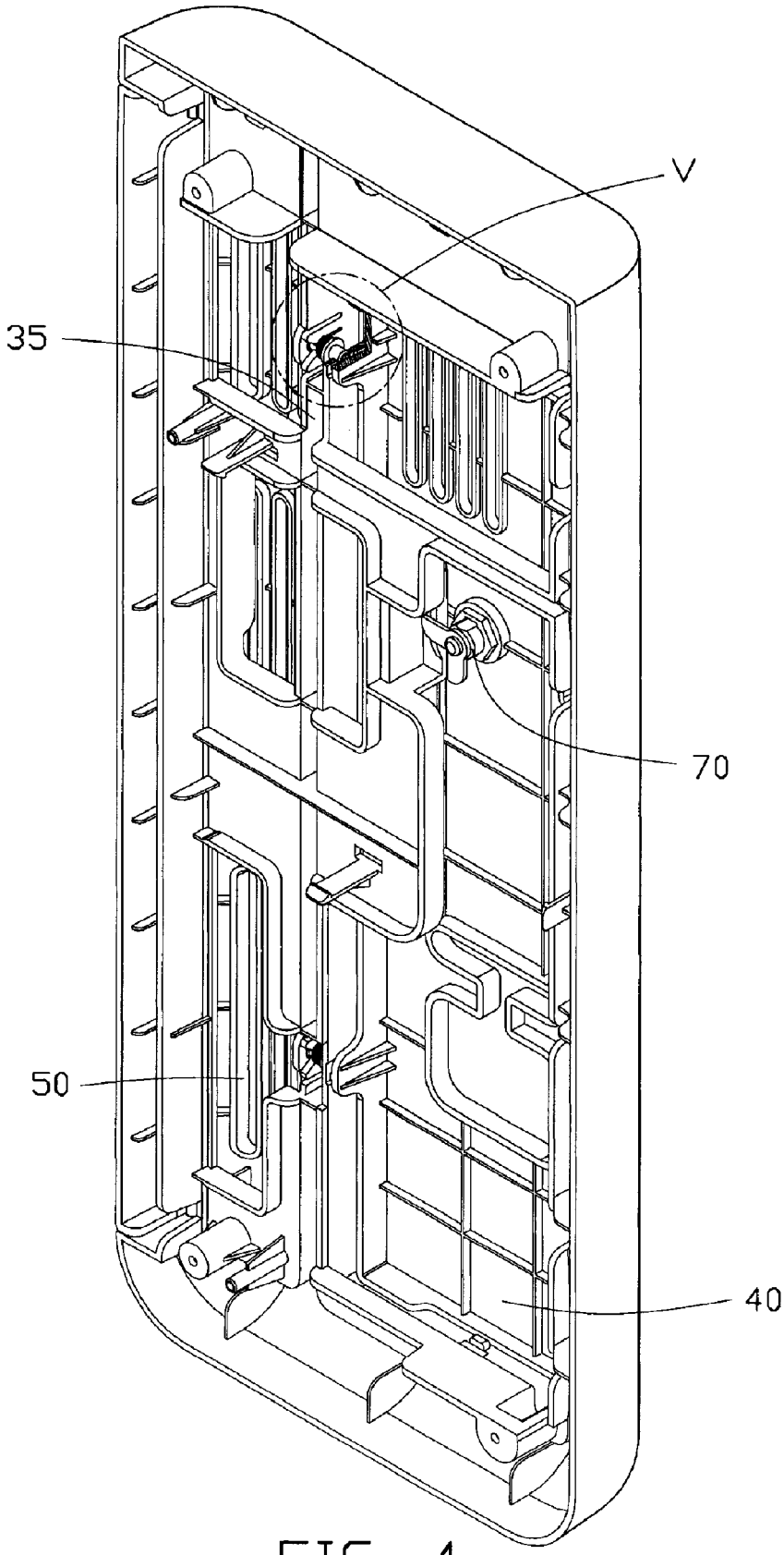
FIG. 4 is an assembled view of FIG. 3, showing a locked position.
Figure 5:
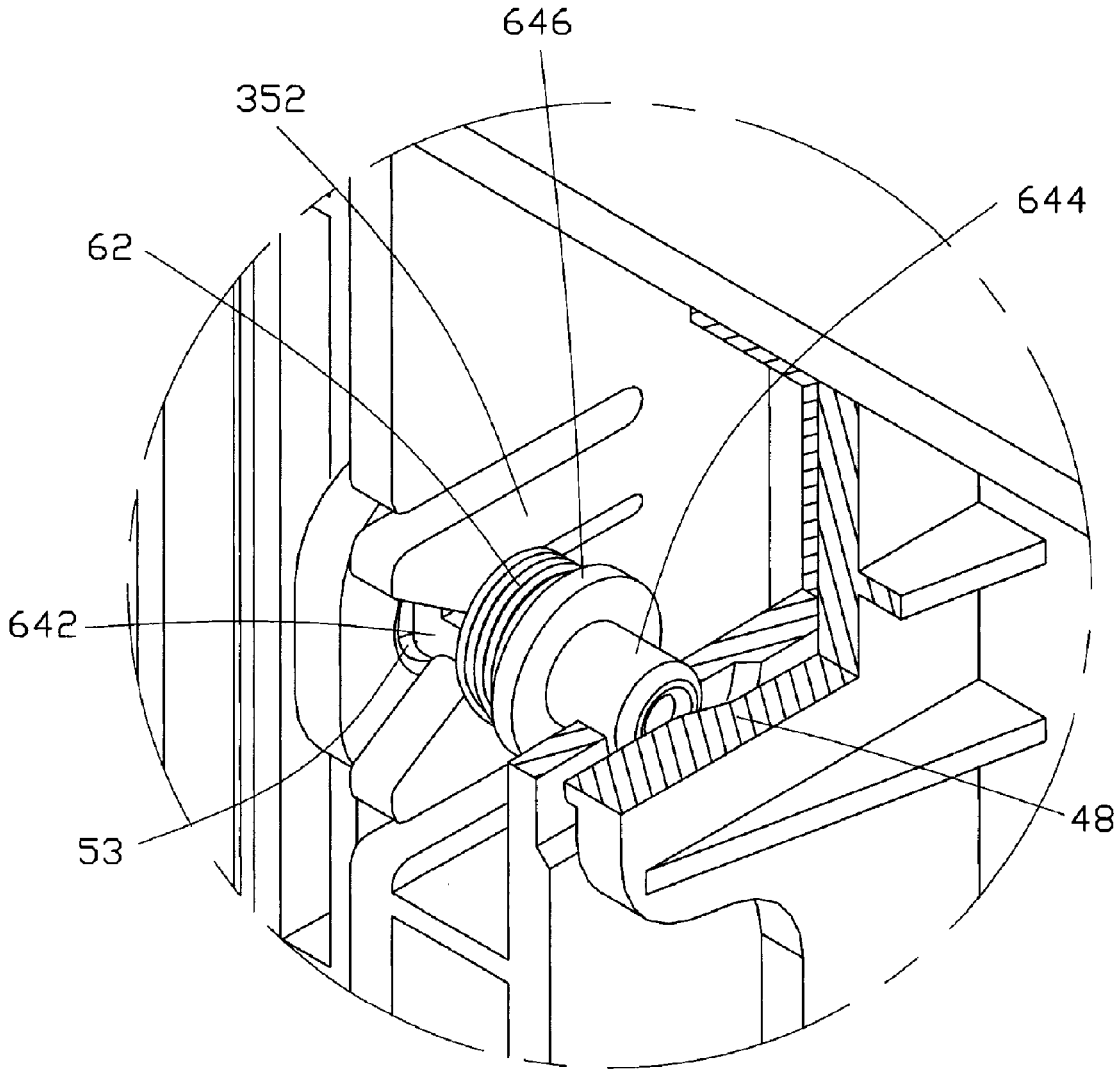
FIG. 5 is an enlarged view of the encircled portion V of FIG. 4.
Figure 6:
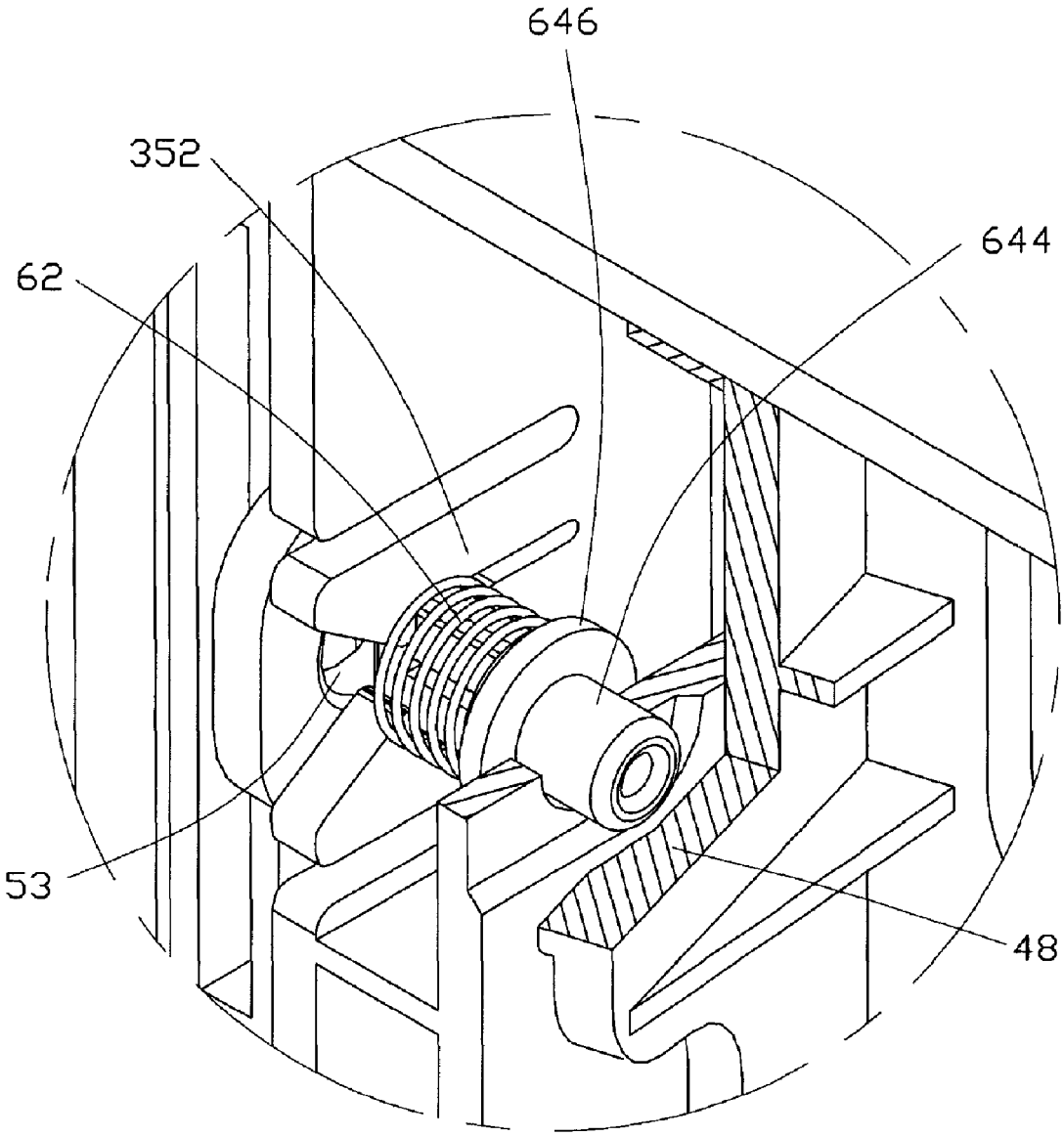
FIG. 6 is similar to FIG. 5, but showing an unlocked position.

Referring also to FIGS. 4-6, the springs 62 are placed around the first pin portions 642 of the latch 64, respectively. Each spring 62 is compressed, so as to allow each latch 64 entering the crossbeam 35 from the opening. Meanwhile, the first pin portion 642 of each latch 64 squeezes into the receiving space of the fastening portion 352. The springs 62 are then released so as to urge the second pin portions 644 into the through holes 354 of the crossbeam 35. Thus, the latches 64 are capable of moving perpendicularly to/between the side plates of the crossbeam 35.

The first and second covers 40, 50 are respectively pivotally attached to the outer frame 31 at two opposite sides of the crossbeam 35. The second cover 50 is firstly closed, and the through apertures 53 of the second cover 50 are in alignment with the latches 64, respectively. After all connectors and their cables are extended through the first cover 40 to connect with the output/input interfaces of the rear panel 12 and the cables are collected in the accommodating slot 45, the first cover 40 is rotated into the larger region of the outer frame 30. Meanwhile, the blocking plates 48 push the latches 64, so that the first pin portions 642 enter the through apertures 53 of the second cover 50, respectively. The catches 43 of the first cover 40 engage with the outer frame 31 of the bracket 30.

The first cover 40 defines a lock hole 49 for accommodating the lock 70 or other locking means therein. The lock 70 as shown in FIG. 1 includes a lock core 71 and a lever 73. When the first cover 40 is closed, a key is inserted in the lock core 71 and drives the lever 73 to rotate. When the lever 73 is engaged with the locking portion 332, the first cover 40 is secured in a locked position. The second cover 50 is also secured in a locked position by the first cover 40. It will prevent an unauthorized person from plugging or pulling out connectors, or from stealing data from a computer.

When opening the second cover 50 is needed, the first cover 40 must be opened firstly. The lock 70 is screwed with a key to release the first cover 40. The first cover 40 is rotated outwardly so that the blocking plates 48 leave the latches 64. The latches 64 move toward the first cover 40 in the restoring force of the springs 62. The first pin portions 642 are thereby withdrawn from the through apertures 53. The second cover 50 is thus capable of being opened.

In this preferred embodiment, the second cover 50 is designed to be a separate part of the first cover 40, and rotated in a reverse direction of that of the first cover 40. This leaves the side panel 14 a withdrawal distance. If there is an integrated cover rotated at the side of the side panel 14, an undesired distance must be designed between the side panel and the cover for withdrawal of the side panel 14.

The second cover 50 can be opened only when the first cover 40 is opened. The side panel 14 can be disassembled only when the second cover 50 is opened. Thus, only one lock can control the two covers 40, 50 and the side panel 14.

It is believed that the present embodiment and its advantages will be understood from the foregoing description, and it will be apparent that various changes may be made thereto without departing from the spirit and scope of the invention or sacrificing all of its material advantages, the example hereinbefore described merely being a preferred or exemplary embodiment.

What is claimed is:

1. A computer housing comprising:

a computer chassis comprising a rear panel;

a bracket being attached to the rear panel of the computer chassis, the bracket comprising a crossbeam, the crossbeam comprises spaced first and second side plates perpendicular to the rear panel;

a first cover and a second cover each pivotally attached to the bracket and rotated reversely, the first cover rotating relative to a pivot end thereof adjacent to the first side plate of the crossbeam, the second cover rotating relative to a pivot end thereof adjacent to the second side plate of the crossbeam, a blocking plate extending perpendicularly from the pivot end of the first cover, a lug extending perpendicularly from the pivot end of the second cover, the lug defining a through aperture, the crossbeam being located between the first and second covers; and a locking device comprising a latch and a spring, the latch including a first pin portion, a second pin portion, and a flange located between the first pin portion and the second pin portion;

the latch being slidably mounted to the crossbeam while the first pin portion is able to pass through the first side plate of the crossbeam and the second pin portion is able to pass through the second side plate of the crossbeam, the flange being received between the first and second side plates, and two ends of the spring abutting against the second side plate and the flange respectively;

wherein when the first cover is closed, the blocking plate of the first cover presses the first pin portion of the latch so that the second pin portion of the latch is inserted into the through aperture of the lug of the second cover and wherein when the first cover is open, the blocking plate of the first cover leaves the first pin portion of the latch so that the second pin portion of the latch is withdrawn from the through aperture of the lug of the second cover.

2. The computer housing as claimed in claim 1, the first side plate of the crossbeam defining a through hole, the second side plate of the crossbeam forming a fastening portion, the first pin portion of the latch extending through the through hole, and the second pin portion of the latch being disposed in the fastening portion.

3. The computer housing as claimed in claim 2, the fastening portion comprising two opposite hooks, the second pin portion of the latch being a semicolumn disposed between the hooks.

4. The computer housing as claimed in claim 1, further comprising a lock disposed in the first cover for locking the first cover to the bracket.

5. The computer housing as claimed in claim 1, wherein the first and second covers define a plurality of ventilation holes.

6. The computer housing as claimed in claim 1, further comprising a side panel slidably attached to the computer chassis in a back-to-front direction, wherein when the second pin portion of the latch is inserted into the through aperture of the lug, an end of the second cover away from the pivot end of the second cover is able to abut against a rear end of the side panel to prevent the side panel from sliding backward.

* * * * *

UNITED STATES PATENT AND TRADEMARK OFFICE

CERTIFICATE OF CORRECTION

PATENT NO. : 7,665,813 B2
APPLICATION NO. : 11/306454
DATED : February 23, 2010
INVENTOR(S) : Zhao-Yu Wang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 842 days.

Signed and Sealed this

Seventh Day of December, 2010

David J. Kappos

David J. Kappos
*Director of the United States Patent and Trademark Office*